US012516260B2

(12) United States Patent
Russo et al.

(10) Patent No.: US 12,516,260 B2
(45) Date of Patent: Jan. 6, 2026

(54) FUEL COMPOSITIONS

(71) Applicant: SHELL USA, INC., Houston, TX (US)

(72) Inventors: Joseph Michael Russo, Katy, TX (US); Edward Erastus Malisa, Houston, TX (US)

(73) Assignee: SHELL USA, INC., Houston, TX (US)

( * ) Notice: Subject to any disclaimer, the term of this patent is extended or adjusted under 35 U.S.C. 154(b) by 0 days.

(21) Appl. No.: 18/686,904

(22) PCT Filed: Sep. 26, 2022

(86) PCT No.: PCT/EP2022/076627
§ 371 (c)(1),
(2) Date: Jul. 23, 2024

(87) PCT Pub. No.: WO2023/052286
PCT Pub. Date: Apr. 6, 2023

(65) Prior Publication Data

US 2024/0352364 A1 Oct. 24, 2024

Related U.S. Application Data

(60) Provisional application No. 63/249,737, filed on Sep. 29, 2021.

(51) Int. Cl.
*C10L 1/19* (2006.01)
*C10L 10/08* (2006.01)

(52) U.S. Cl.
CPC ..... *C10L 1/1905* (2013.01); *C10L 10/08* (2013.01); *C10L 2200/0423* (2013.01); *C10L 2270/023* (2013.01); *C10L 2300/20* (2013.01)

(58) Field of Classification Search
CPC ..... C10L 1/1905; C10L 10/08; C10L 2200/0423; C10L 2270/023; C10L 2300/20
See application file for complete search history.

(56) References Cited

U.S. PATENT DOCUMENTS 1,995,615 A * 3/1935 Jaeger ..... C10L 1/14 44/350
2,682,489 A * 6/1954 Hugo ..... C10M 1/08 148/252

(Continued)

FOREIGN PATENT DOCUMENTS

CN 106929112 * 7/2017
CN 106929112 A 7/2017

(Continued)

OTHER PUBLICATIONS

International Search Report and Written Opinion received for PCT Patent Application No. PCT/EP2022/076627, mailed on Dec. 23, 2022, 10 pages.

(Continued)

*Primary Examiner* — Cephia D Toomer
(74) *Attorney, Agent, or Firm* — SHELL USA, INC.

(57) ABSTRACT

Fuel composition comprising:
(i) a base fuel suitable for use in an internal combustion engine; and
(ii) a blend of a first monoalkyl alkenyl succinate and a second monoalkyl alkenyl succinate wherein the first monoalkyl alkenyl succinate and the second monoalkyl alkenyl succinate each have the formula (I) or (II) below, or are an isomeric mixture of formula (I) and (II) below:

(I)

(Continued)

-continued (II)

where R is a linear or branched alkenyl group containing from 4 to 30 carbon atoms, and $R^1$ is a linear or branched $C_1$ to $C_8$ alkyl group;

and wherein the first monoalkyl alkenyl succinate is different from the second monoalkyl alkenyl succinate.

The fuel compositions of the present invention have been found to provide a synergistic reduction in engine wear.

12 Claims, 3 Drawing Sheets

(56) References Cited

U.S. PATENT DOCUMENTS

| | | | |
|---|---|---|---|
| 2,993,773 | A | 7/1961 | Stromberg et al. |
| 3,687,644 | A | 8/1972 | Delafield et al. |
| 4,849,572 | A | 7/1989 | Chen et al. |
| 4,877,416 | A | 10/1989 | Campbell |
| 5,004,478 | A | 4/1991 | Vogel et al. |
| 5,112,364 | A | 5/1992 | Rath et al. |
| 5,298,039 | A | 3/1994 | Mohr et al. |
| 5,660,601 | A | 8/1997 | Oppenläender et al. |
| 5,746,786 | A | 5/1998 | Mueller et al. |
| 5,855,629 | A | 1/1999 | Grundy et al. |
| 5,876,468 | A | 3/1999 | Moreton |
| 6,069,281 | A | 5/2000 | Kropp et al. |
| 6,140,541 | A | 10/2000 | Melder et al. |
| 6,267,791 | B1 | 7/2001 | Thomas et al. |
| 7,435,273 | B2 | 10/2008 | Lange et al. |
| 7,901,470 | B2 | 3/2011 | Graupner et al. |
| 8,372,164 | B2 | 2/2013 | Haan et al. |
| 8,486,876 | B2 | 7/2013 | Brewer et al. |
| 9,206,366 | B2 | 12/2015 | Bauldreay et al. |
| 10,308,889 | B1 | 6/2019 | Colucci et al. |
| 2009/0235576 | A1 | 9/2009 | Volkel et al. |
| 2010/0000484 | A1 | 1/2010 | Felix-moore et al. |
| 2020/0095513 | A1* | 3/2020 | Petts ..... C10L 10/06 |

FOREIGN PATENT DOCUMENTS

| | | | |
|---|---|---|---|
| EP | 0310875 | A1 | 4/1989 |
| JP | H09324185 | A | 12/1997 |
| KR | 20110104714 | A | 9/2011 |

OTHER PUBLICATIONS

Baek et al., "Synthesis of Succinic Acid Alkyl Half-ester Derivatives With Improved Lubricity Characteristics", Industrial & Engineering Chemistry Research, Feb. 9, 2012, vol. 51, Issue No. 9, pp. 3564-3568.

Lang et al., "In-depth Analysis of Additive-treated Gasoline With a Modified Hfrr Technique", SAE International Journal of Fuels and Lubricants, 2020, vol. 13, Issue No. 1, pp. 19-35.

Wei et al., "The Lubricity of Gasoline", Tribology Transactions, 1999, vol. 42, Issue No. 4, pp. 813-823.

* cited by examiner

FUEL COMPOSITIONS

CROSS REFERENCE TO RELATED APPLICATIONS

This is a National stage application of International Application No. PCT/EP2022/076627, filed 26 Sep. 2022, which claims priority of U.S. Provisional Application No. 63/249,737 filed 29 Sep. 2021 which is incorporated herein by reference in its entirety.

FIELD OF THE INVENTION

The present invention relates to a liquid fuel composition, in particular to a liquid fuel composition having improved wear properties. The present invention also relates to the use of a certain combination of additive components in a liquid fuel composition for providing a synergistic reduction in engine wear.

BACKGROUND OF THE INVENTION

Consumers of fuel products are looking for excellent fuel economy, acceleration and efficiency benefits, as well as deposit control. Surface modifiers are one way to achieve efficiency by modifying the engine surfaces to provide wear protection and/or a lower friction coefficient. Surface modifier components, also known as surfactants or surface active agents, have both a hydrophilic and lipophilic group, which allows the component to be attracted to the metal surface, and yet allow it to be soluble within the hydrocarbon environment.

In addition to the polar and non-polar head of the surface modifier molecule, it is important for such molecules to align themselves on the metal surface so they can form a protective chemical wall. Molecular weight, stereochemical structure and polar group all work together to achieve the efficiency of the protective nature of the molecule. If the alkyl chain varies or contains a side chain so the molecules can't pack closely, or the molecular weight of the molecule is too low or at times too high, the efficiency of the protection will drastically decrease.

Alkyl succinates are known surface modifier compounds. They are prepared by the reaction of an alcohol with a succinic anhydride which results in the isomeric products shown below:

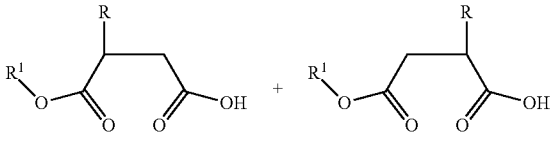

U.S. Pat. No. 3,687,644A relates to alkyl succinate chemistry in terms of its use as an anti-icing aid. Seung-Yeob Baek, "Synthesis of Succinic Acid Alkyl Half-Ester Derivatives with Improved Lubricity Characteristics", Ind. Eng. Chem. Res. 2012, 51, pg 3564-3568 relates to the synthesis and use of the alkyl succinates as diesel lubricity aids. However, neither of these documents mention the use of alkyl succinate gasoline in their ability to reduce wear and friction, nor the use of alkyl succinate blends.

US2009/235576A1 relates to hydrocarbyl succinic acid and hydrocarbyl succinic acid derivatives as friction modifiers for gasolines. However, this document does not mention the use of alkenyl succinate blends.

It has now surprisingly been found that the use of a certain combination of alkenyl succinate components in a liquid fuel composition can provide a synergistic reduction in engine wear.

SUMMARY OF THE INVENTION

According to the present invention there is provided a fuel composition comprising:

(i) a base fuel suitable for use in an internal combustion engine; and (ii) a blend of a first monoalkyl alkenyl succinate and a second monoalkyl alkenyl succinate wherein the first monoalkyl alkenyl succinate and the second monoalkyl alkenyl succinate each have the formula (I) or (II) below, or are an isomeric mixture of formula (I) and (II) below:

(I)

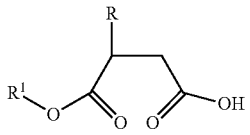

(II)

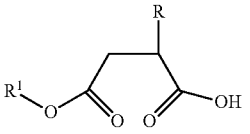

where R is a linear or branched alkenyl group containing from 4 to 30 carbon atoms, and $R^1$ is a linear or branched C1 to C8 alkyl group;

and wherein the first monoalkyl alkenyl succinate is different from the second monoalkyl alkenyl succinate.

It has been surprisingly found that the fuel compositions of the present invention can provide a synergistic reduction in engine wear.

According to another aspect of the present invention there is provided a method of providing a synergistic reduction in engine wear of an internal combustion engine, said method comprising fueling the internal combustion engine with a liquid fuel composition described herein below.

According to yet another aspect of the present invention there is provided the use of a liquid fuel composition as described herein for providing a synergistic reduction in engine wear.

DETAILED DESCRIPTION OF THE INVENTION

Figure 1:
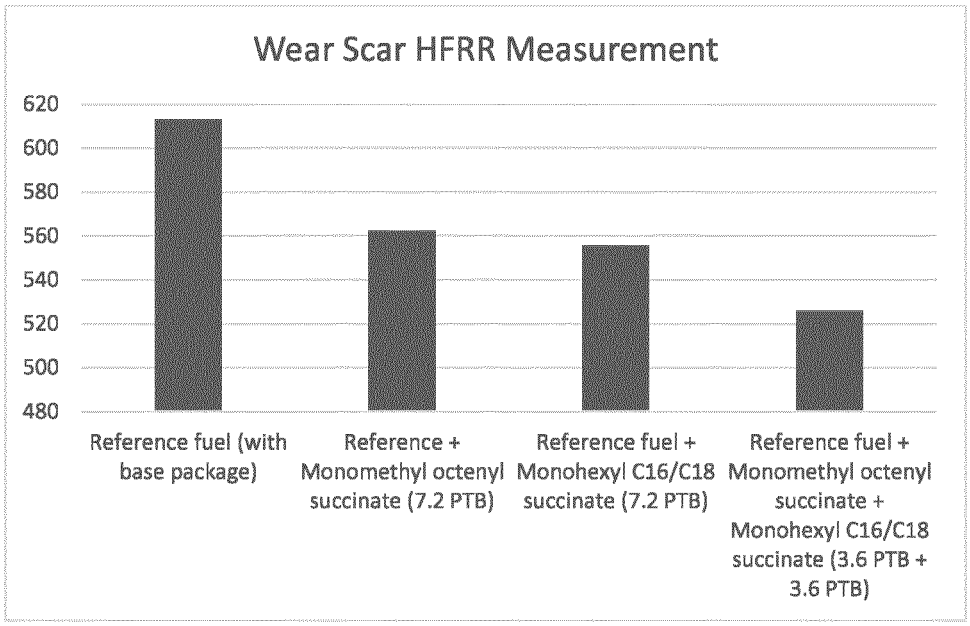
FIG. 1 is a graphical representation of the data shown in Table 3 below.

In order to assist with the understanding of the invention several terms are defined herein.

The fuel compositions of the present invention comprise a base fuel and a blend of at least two monoalkyl alkenyl succinates.

The fuel compositions of the present invention provide a synergistic reduction in engine wear. As used herein the term 'synergistic reduction in engine wear' means that the reduction in engine wear obtained with the fuel composition of the present invention comprising a blend of a first monoalkyl alkenyl succinate and a second monoalkyl alkenyl succinate as described herein is greater than the simple sum of the engine wear reduction obtained with an analogous fuel formulation containing the first monoalkyl alkenyl succinate alone (i.e. without the second monoalkyl alkenyl succinate) and the engine wear reduction obtained with an analogous fuel formulation containing the second monoalkyl alkenyl succinate alone (i.e. without the first monoalkyl alkenyl succinate). In other words, the reduction in engine wear obtained via the compositions, uses and methods of the present invention are synergistic rather than additive.

In the context of the present invention, the term "reduction in engine wear' may for instance be 0.05% or more, preferably 0.1% or more, more preferably 0.2% or more, even more preferably 0.5% or more, especially 1% or more, more especially 2% or more and even more especially 5% or more than the reduction in engine wear provided by the simple sum of the engine wear reduction obtained with an analogous fuel formulation containing the first monoalkyl alkenyl succinate alone (i.e. without the second monoalkyl alkenyl succinate) and the engine wear reduction obtained with an analogous fuel formulation containing the second monoalkyl alkenyl succinate alone (i.e. without the first monoalkyl alkenyl succinate). The reduction in engine wear may even be as high as 20% more than the reduction in engine wear provided by the simple sum of the engine wear reduction obtained with an analogous fuel formulation containing the first monoalkyl alkenyl succinate alone (i.e. without the second monoalkyl alkenyl succinate) and the engine wear reduction obtained with an analogous fuel formulation containing the second monoalkyl alkenyl succinate alone (i.e. without the first monoalkyl alkenyl succinate).

Engine wear can be measured using any suitable method known to those skilled in the art. A preferred method for measuring the effect of a fuel composition on engine wear reduction is by using a High Frequency Reciprocating Rig (HFRR) per a modified version of ASTM D6079 using a gasoline conversion kit available from PCS Instruments (London, UK). The modified test used a sample cup having a lid to prevent volatility. The sample volume was 15 mL and the sample temperature was held at 25° C. Film coverage was measured on a Quartz Crystal Microbalance (QCM). In such method the wear scar diameter (μm) exhibited by the fuel composition is measured. The lower the value of the wear scar diameter, the better the wear performance of the fuel composition being tested. Further details of the above-mentioned modified HFRR test method can be found in 'In-Depth Analysis of Additive-Treated Gasoline with a Modified HERR Technique', Wendy Lang, Edward Malisa, Joseph Russo, Andreas Galwar, John Mengwasser, William Colucci, Kristine Morel and Edward Nelson, SAE Int. J. Fuels Lubr., Volume 13, Issue 1, 2020. Such method is also disclosed in U.S. Ser. No. 10/308,889.

The liquid fuel composition of the present invention comprises a base fuel suitable for use in an internal combustion engine, and a blend of monoalkyl alkenyl succinates comprising a first monoalkyl alkenyl succinate and a second monoalkyl alkenyl succinate wherein the first monoalkyl alkenyl succinate and the second monoalkyl alkenyl succinate each have the formula (I) or (II) below, or are an isomeric mixture of formula (I) and (II) below:

(I)

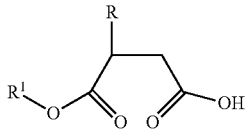

(II)

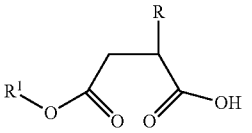

where R is a linear or branched chain alkenyl group containing from 4 to 30 carbon atoms, and $R^1$ is a linear or branched C1 to C8 alkyl group.

Importantly, the first monoalkyl alkenyl succinate is different from the second monoalkyl alkenyl succinate.

In formula (I) and (II) above, the R group is an unsaturated hydrocarbyl group attached to the ring; this is done by alkylation of maleic anhydride with an olefin. Once the olefin reacts, the double bond present will move from the alpha beta position in the olefin to the beta gamma position in the alkylated succinic anhydride. Therefore, there is unsaturation in the R group, and the R group is a so-called alkenyl group.

In formula (I) and (II) above, the R1 group is an alkyl group.

In one embodiment, the first monoalkyl alkenyl succinate is a compound of formula (I) or (II), or an isomeric mixture of formula (I) and (II), wherein R is a linear or branched alkenyl group containing from 4 to 8 carbon atoms, and $R^1$ is a C1 to C4 straight chain or branched alkyl group.

In a preferred embodiment, the first monoalkyl alkenyl succinate is a compound of formula (I) or (II), or an isomeric mixture of formula (I) and (II), wherein R is a linear or branched alkenyl group containing from 6 to 8 carbon atoms, and $R^1$ is a linear or branched C1 to C3 alkyl group.

In an especially preferred embodiment, the first monoalkyl alkenyl succinate is a compound of formula (I) or (II) or an isomeric mixture of formula (I) and (II), wherein R is a linear alkenyl group containing 8 carbon atoms (i.e. octenyl), and $R^1$ is selected from methyl, ethyl and isopropyl, preferably methyl and isopropyl.

In one embodiment, the second monoalkyl alkenyl succinate is a compound of formula (I) or (II), or an isomeric mixture of formula (I) and (II), wherein R is a linear or branched alkenyl group containing from 10 to 22 carbon atoms, and $R^1$ is a linear or branched C1 to C6 alkyl group.

In a preferred embodiment, the second monoalkyl alkenyl succinate is a compound of formula (I) or (II), or an isomeric mixture of formula (I) and (II), wherein R is a linear or branched alkenyl group containing from 12 to 18 carbon atoms, and $R^1$ is a linear or branched C1 to C6 alkyl group.

In an especially preferred embodiment, the second monoalkyl alkenyl succinate is a compound of formula (I) or (II) or an isomeric mixture of formula (I) and (II), wherein R is a linear alkenyl group containing from 12 to 18 carbon atoms, and $R^1$ is selected from methyl, ethyl, isopropyl, pentyl and hexyl, preferably methyl, isopropyl and hexyl.

In a preferred embodiment herein, the R group in the first monoalkyl alkenyl succinate is different from the R group in the second monoalkyl alkenyl succinate. In particular, it is preferred that the R group in the second monoalkyl alkenyl succinate is longer than the R group in the first monoalkyl alkenyl succinate.

In one preferred embodiment herein, when the R group in the first monoalkyl alkenyl succinate is a C8 octenyl group, the R group in the second monoalkyl alkenyl succinate is not a C8 octenyl group.

Preferred monoalkyl alkenyl succinates for use as the first monoalkyl alkenyl succinates herein are selected from monomethyl octenyl succinate and monoisopropyl octenyl succinate.

Preferred monoalkyl alkenyl succinates for use as the second monoalkyl alkenyl succinates herein are selected from monohexyl C16C18 succinate (where C16C18 means a mixture of alkenyl groups containing 16 and 18 carbon atoms), monomethyl octadecenyl succinate, monohexyl dodecenyl succinate.

Preferred blends of monoalkyl alkenyl succinates for use herein, especially from the viewpoint of providing a synergistic reduction in wear, include:

Monomethyl octenylsuccinate and monohexyl C16C18 succinate;

Monomethyl octenylsuccinate and monomethyl octadecenyl succinate; and

Monoisopropyl octenyl succinate and monohexyl dodecenyl succinate.

Preferably, the total amount of first monoalkyl alkenyl succinate and second monoalkyl alkenyl succinate is in the range from 2PTB to 262.3PTB (1000 ppmw), preferably from 3 PTB to 100PTB, more preferably from 3.6 PTB to 14 PTB, by weight of the fuel composition.

Preferably, the amount of first monoalkyl alkenyl succinate is in the range from 1PTB to 131.2PTB (500 ppmw), more preferably from 1.5 PTB to 50 PTB, even more preferably from 1.8 PTB to 7PTB, by weight of the fuel composition.

Preferably, the amount of second monoalkyl alkenyl succinate is in the range from 1PTB to 131.2PTB (500 ppmw), more preferably from 1.5 PTB to 50 PTB, even more preferably from 1.8 PTB to 7 PTB, by weight of the fuel composition.

In a preferred embodiment, the weight ratio of first monoalkyl alkenyl succinate to second monoalkyl alkenyl succinate is in the range from 90:10 to 10:90, more preferably from 80:20 to 20:80, even more preferably from 70:30 to 30:70, and especially 50:50.

In a preferred embodiment of the present invention, the blend of monoalkyl alkenyl succinates contains two monoalkyl alkenyl succinates, i.e. a first monoalkykl alkenyl succinate and a second monoalkyl alkenyl succinate. However, it is also with the ambit of the present invention for the blend of monoalkyl alkenyl succinates to include one or more further monoalkyl alkenyl succinates in addition to the first monoalkyl alkenyl succinate and the second alkenyl succinate.

The monoalkyl alkenyl succinates can be prepared by reacting an alkenyl succinic anhydride with the corresponding alcohol using standard techniques known in the art.

The blend of monoalkyl alkenyl succinates may be blended together with any other additives e.g. additive performance package(s) to produce an additive blend. The additive blend is then added to a base fuel to produce a liquid fuel composition.

The amount of performance package(s) in the additive blend is preferably in the range of from 0.1 to 99.8 wt %, more preferably in the range of from 5 to 50 wt %, by weight of the additive blend.

Preferably, the amount of the performance package present in the liquid fuel composition of the present invention is in the range of 15 ppmw (parts per million by weight) to 10% wt, based on the overall weight of the liquid fuel composition. More preferably, the amount of the performance package present in the liquid fuel composition of the present invention additionally accords with one or more of the parameters (i) to (xv) listed below:

(i) at least 100 ppmw
(ii) at least 200 ppmw
(iii) at least 300 ppmw
(iv) at least 400 ppmw
(v) at least 500 ppmw
(vi) at least 600 ppmw
(vii) at least 700 ppmw
(viii) at least 800 ppmw
(ix) at least 900 ppmw
(x) at least 1000 ppmw
(xi) at least 2500 ppmw
(xii) at most 5000 ppmw
(xiii) at most 10000 ppmw
(xiv) at most 2% wt.
(xv) at most 5% wt.

The base fuel suitable for use in an internal combustion engine can be a gasoline or a diesel fuel, and therefore the liquid fuel composition of the present invention is a gasoline composition or a diesel fuel composition, respectively. In the fuel compositions herein, the base fuel is preferably a gasoline.

In the liquid fuel compositions of the present invention, if the base fuel used is a gasoline, then the gasoline may be any gasoline suitable for use in an internal combustion engine of the spark-ignition (petrol) type known in the art, including automotive engines as well as in other types of engine such as, for example, off road and aviation engines. The gasoline used as the base fuel in the liquid fuel composition of the present invention may conveniently also be referred to as 'base gasoline'.

Gasolines typically comprise mixtures of hydrocarbons boiling in the range from 25 to 230° C. (EN-ISO 3405), the optimal ranges and distillation curves typically varying according to climate and season of the year. The hydrocarbons in a gasoline may be derived by any means known in the art, conveniently the hydrocarbons may be derived in any known manner from straight-run gasoline, synthetically-produced aromatic hydrocarbon mixtures, thermally or catalytically cracked hydrocarbons, hydro-cracked petroleum fractions, catalytically reformed hydrocarbons or mixtures of these.

The specific distillation curve, hydrocarbon composition, research octane number (RON) and motor octane number (MON) of the gasoline are not critical.

Conveniently, the research octane number (RON) of the gasoline may be at least 80, for instance in the range of from 80 to 110, preferably the RON of the gasoline will be at least 90, for instance in the range of from 90 to 110, more preferably the RON of the gasoline will be at least 91, for instance in the range of from 91 to 105, even more preferably the RON of the gasoline will be at least 92, for instance in the range of from 92 to 103, even more preferably the RON of the gasoline will be at least 93, for instance in the range of from 93 to 102, and most preferably the RON of the gasoline will be at least 94, for instance in the range of from 94 to 100 (EN 25164); the motor octane number (MON) of the gasoline may conveniently be at least 70, for instance in the range of from 70 to 110, preferably the MON of the gasoline will be at least 75, for instance in the range of from 75 to 105, more preferably the MON of the gasoline will be at least 80, for instance in the range of from 80 to 100, most preferably the MON of the gasoline will be at least 82, for instance in the range of from 82 to 95 (EN 25163).

Typically, gasolines comprise components selected from one or more of the following groups; saturated hydrocarbons, olefinic hydrocarbons, aromatic hydrocarbons, and oxygenated hydrocarbons. Conveniently, the gasoline may comprise a mixture of saturated hydrocarbons, olefinic hydrocarbons, aromatic hydrocarbons, and, optionally, oxygenated hydrocarbons.

Typically, the olefinic hydrocarbon content of the gasoline is in the range of from 0 to 40 percent by volume based on the gasoline (ASTM D1319); preferably, the olefinic hydrocarbon content of the gasoline is in the range of from 0 to 30 percent by volume based on the gasoline, more preferably, the olefinic hydrocarbon content of the gasoline is in the range of from 0 to 20 percent by volume based on the gasoline.

Typically, the aromatic hydrocarbon content of the gasoline is in the range of from 0 to 70 percent by volume based on the gasoline (ASTM D1319), for instance the aromatic hydrocarbon content of the gasoline is in the range of from 10 to 60 percent by volume based on the gasoline; preferably, the aromatic hydrocarbon content of the gasoline is in the range of from 0 to 50 percent by volume based on the gasoline, for instance the aromatic hydrocarbon content of the gasoline is in the range of from 10 to 50 percent by volume based on the gasoline. In one embodiment herein the gasoline base fuel comprises less than 10 volt of aromatics, based on the total base fuel. In another embodiment herein, the gasoline base fuel comprises less than 2 vol % of aromatics having 9 carbon atoms or greater, based on the total base fuel.

The benzene content of the gasoline is at most 10 percent by volume, more preferably at most 5 percent by volume, especially at most 1 percent by volume based on the gasoline.

The gasoline preferably has a low or ultra low sulphur content, for instance at most 1000 ppmw (parts per million by weight), preferably no more than 500 ppmw, more preferably no more than 100, even more preferably no more than 50 and most preferably no more than even 10 ppmw.

The gasoline also preferably has a low total lead content, such as at most 0.005 g/l, most preferably being lead free—having no lead compounds added thereto (i.e. unleaded).

When the gasoline comprises oxygenated hydrocarbons, at least a portion of non-oxygenated hydrocarbons will be substituted for oxygenated hydrocarbons (match-blending) or simply added to the fully formulated gasoline (splash-blending). The oxygenate content of the gasoline may be up to 85 percent by weight (EN 1601) (e.g. ethanol per se) based on the gasoline. For example, the oxygenate content of the gasoline may be up to 35 percent by weight, preferably up to 25 percent by weight, more preferably up to 10 percent by weight. Conveniently, the oxygenate concentration will have a minimum concentration selected from any one of 0, 0.2, 0.4, 0.6, 0.8, 1.0, and 1.2 percent by weight, and a maximum concentration selected from any one of 12, 8, 7.2, 5, 4.5, 4.0, 3.5, 3.0, and 2.7 percent by weight.

Examples of oxygenated hydrocarbons that may be incorporated into the gasoline include alcohols, ethers, esters, ketones, aldehydes, carboxylic acids and their derivatives, and oxygen containing heterocyclic compounds. Preferably, the oxygenated hydrocarbons that may be incorporated into the gasoline are selected from alcohols (such as methanol, ethanol, propanol, 2-propanol, butanol, tert-butanol, isobutanol and 2-butanol), ethers (preferably ethers containing 5 or more carbon atoms per molecule, e.g., methyl tert-butyl ether and ethyl tert-butyl ether) and esters (preferably esters containing 5 or more carbon atoms per molecule); a particularly preferred oxygenated hydrocarbon is ethanol.

When oxygenated hydrocarbons are present in the gasoline, the amount of oxygenated hydrocarbons in the gasoline may vary over a wide range. For example, gasolines comprising a major proportion of oxygenated hydrocarbons are currently commercially available in countries such as Brazil and U.S.A., e.g. ethanol per se and E85, as well as gasolines comprising a minor proportion of oxygenated hydrocarbons, e.g. E10 and E5. Therefore, the gasoline may contain up to 100 percent by volume oxygenated hydrocarbons. E100 fuels as used in Brazil are also included herein. Preferably, the amount of oxygenated hydrocarbons present in the gasoline is selected from one of the following amounts: up to 85 percent by volume; up to 70 percent by volume; up to 65 percent by volume; up to 30 percent by volume; up to 20 percent by volume; up to 15 percent by volume; and, up to 10 percent by volume, depending upon the desired final formulation of the gasoline. Conveniently, the gasoline may contain at least 0.5, 1.0 or 2.0 percent by volume oxygenated hydrocarbons.

Examples of suitable gasolines include gasolines which have an olefinic hydrocarbon content of from 0 to 20 percent by volume (ASTM D1319), an oxygen content of from 0 to 5 percent by weight (EN 1601), an aromatic hydrocarbon content of from 0 to 50 percent by volume (ASTM D1319) and a benzene content of at most 1 percent by volume.

Also suitable for use herein are gasoline blending components which can be derived from sources other than crude oil, such as low carbon gasoline fuels from either biomass or $CO_2$, and blends thereof which each other or with fossil-derived gasoline streams and components. Suitable examples of such fuels include:

1) Biomass derived:
   a. Straight run bio-naphthas from hydrodeoxygenation of biomass, and
   b. cracked and/or isomerized products of syn-wax (biomass gasification to syngas ($CO/H_2$) to syn-wax by the FT process), which is then hydrocracked/hydroisomerized to yield a slate of products including cuts in the gasoline distillation range.
2) $CO_2$ derived:
   a. $CO_2$+$H_2$ syngas ($CO/H_2$) by modified water/gas shift reaction to syn-wax by the FT process), which is then hydrocracked/hydroisomerized to yield a slate of products including cuts in the gasoline distillation range.
3) Methanol derived:
   a. Biomass gasification to syngas ($CO/H_2$) to Methanol to MTG gasoline (MTG is 'methanol-to-gasoline' process). To reduce the carbon intensity of the fuel further, the $H_2$ used in all processes would be renewable (green) $H_2$ from electrolysis of water using renewable electricity such as from wind and solar.

Particularly suitable for use herein are gasoline blending components which can be derived from a biological source.

Examples of such gasoline blending components can be found in WO2009/077606, WO2010/028206, WO2010/000761, European patent application nos. 09160983.4, 09176879.6, 09180904.6, and U.S. patent application Ser. No. 61/312,307.

Whilst not critical to the present invention, the base gasoline or the gasoline composition of the present invention may conveniently include one or more optional fuel additives, in addition to the essential blend of monoalkyl alkenyl succinates mentioned above. The concentration and nature of the optional fuel additive(s) that may be included in the base gasoline or the gasoline composition of the present invention is not critical. Non-limiting examples of suitable types of fuel additives that can be included in the base gasoline or the gasoline composition of the present invention include anti-oxidants, corrosion inhibitors, detergents, dehazers, antiknock additives, metal deactivators, valve-seat recession protectant compounds, dyes, solvents, carrier fluids, diluents and markers. Examples of suitable such additives are described generally in, for example U.S. Pat. No. 5,855,629

Conveniently, the fuel additives can be blended with one or more solvents to form an additive concentrate, the additive concentrate can then be admixed with the base gasoline or the gasoline composition of the present invention.

The (active matter) concentration of any optional additives present in the base gasoline or the gasoline composition of the present invention is preferably up to 1 percent by weight, more preferably in the range from 5 to 2000 ppmw, advantageously in the range of from 300 to 1500 ppmw, such as from 300 to 1000 ppmw.

As stated above, the gasoline composition may also contain synthetic or mineral carrier oils and/or solvents.

Examples of suitable mineral carrier oils are fractions obtained in crude oil processing, such as brightstock or base oils having viscosities, for example, from the SN 500-2000 class; and also aromatic hydrocarbons, paraffinic hydrocarbons and alkoxyalkanols. Also useful as a mineral carrier oil is a fraction which is obtained in the refining of mineral oil and is known as "hydrocrack oil" (vacuum distillate cut having a boiling range of from about 360 to 500° C., obtainable from natural mineral oil which has been catalytically hydrogenated under high pressure and isomerized and also deparaffinized).

Examples of suitable synthetic carrier oils are: polyolefins (poly-alpha-olefins or poly (internal olefin)s), (poly)esters, (poly)alkoxylates, polyethers, aliphatic polyether amines, alkylphenol-started polyethers, alkylphenol-started polyether amines and carboxylic esters of long-chain alkanols.

Examples of suitable polyolefins are olefin polymers, in particular based on polybutene or polyisobutene (hydrogenated or nonhydrogenated).

Examples of suitable polyethers or polyetheramines are preferably compounds comprising polyoxy-$C_2$-$C_4$-alkylene moieties which are obtainable by reacting $C_2$-$C_{60}$-alkanols, $C_6$-$C_{30}$-alkanediols, mono- or di-$C_2$-$C_{30}$-alkylamines, $C_1$-$C_{30}$-alkylcyclohexanols or $C_1$-$C_{30}$-alkylphenols with from 1 to 30 mol of ethylene oxide and/or propylene oxide and/or butylene oxide per hydroxyl group or amino group, and, in the case of the polyether amines, by subsequent reductive amination with ammonia, monoamines or polyamines. Such products are described in particular in EP-A-310 875, EP-A-356 725, EP-A-700 985 and U.S. Pat. No. 4,877,416. For example, the polyether amines used may be poly-$C_2$-$C_6$-alkylene oxide amines or functional derivatives thereof. Typical examples thereof are tridecanol butoxylates or isotridecanol butoxylates, isononylphenol butoxylates and also polyisobutenol butoxylates and propoxylates, and also the corresponding reaction products with ammonia.

Examples of carboxylic esters of long-chain alkanols are in particular esters of mono-, di- or tricarboxylic acids with long-chain alkanols or polyols, as described in particular in DE-A-38 38 918. The mono-, di- or tricarboxylic acids used may be aliphatic or aromatic acids; suitable ester alcohols or polyols are in particular long-chain representatives having, for example, from 6 to 24 carbon atoms. Typical representatives of the esters are adipates, phthalates, isophthalates, terephthalates and trimellitates of isooctanol, isononanol, isodecanol and isotridecanol, for example di-(n- or isotridecyl) phthalate.

Further suitable carrier oil systems are described, for example, in DE-A-38 26 608, DE-A-41 42 241, DE-A-43 09 074, EP-A-0 452 328 and EP-A-0 548 617, which are incorporated herein by way of reference.

Examples of particularly suitable synthetic carrier oils are alcohol-started polyethers having from about 5 to 35, for example from about 5 to 30, $C_3$-$C_6$-alkylene oxide units, for example selected from propylene oxide, n-butylene oxide and isobutylene oxide units, or mixtures thereof. Non-limiting examples of suitable starter alcohols are long-chain alkanols or phenols substituted by long-chain alkyl in which the long-chain alkyl radical is in particular a straight-chain or branched $C_6$-$C_{18}$-alkyl radical. Preferred examples include tridecanol and nonylphenol.

Further suitable synthetic carrier oils are alkoxylated alkylphenols, as described in DE-A-10 102 913.6.

Mixtures of mineral carrier oils, synthetic carrier oils, and mineral and synthetic carrier oils may also be used.

Any solvent and optionally co-solvent suitable for use in fuels may be used. Examples of suitable solvents for use in fuels include: non-polar hydrocarbon solvents such as kerosene, heavy aromatic solvent ("solvent naphtha heavy", "Solvesso 150"), toluene, xylene, paraffins, petroleum, white spirits, those sold by Shell companies under the trademark "SHELLSOL", and the like. Examples of suitable co-solvents include: polar solvents such as esters and, in particular, alcohols (e.g. t-butanol, i-butanol, hexanol, 2-ethylhexanol, 2-propyl heptanol, decanol, isotridecanol, butyl glycols, and alcohol mixtures such as those sold by Shell companies under the trade mark "LINEVOL", especially LINEVOL 79 alcohol which is a mixture of $C_{7-9}$ primary alcohols, or a $C_{12-14}$ alcohol mixture which is commercially available).

Dehazers/demulsifiers suitable for use in liquid fuels are well known in the art. Non-limiting examples include glycol oxyalkylate polyol blends (such as sold under the trade designation TOLAD™ 9312), alkoxylated phenol formaldehyde polymers, phenol/formaldehyde or $C_{1-18}$ alkylphenol/-formaldehyde resin oxyalkylates modified by oxyalkylation with $C_{1-18}$ epoxides and diepoxides (such as sold under the trade designation TOLAD™ 9308), and $C_{1-4}$ epoxide copolymers cross-linked with diepoxides, diacids, diesters, diols, diacrylates, dimethacrylates or diisocyanates, and blends thereof. The glycol oxyalkylate polyol blends may be polyols oxyalkylated with $C_{1-4}$ epoxides. The $C_{1-18}$ alkylphenol phenol/-formaldehyde resin oxyalkylates modified by oxyalkylation with $C_{1-18}$ epoxides and diepoxides may be based on, for example, cresol, t-butyl phenol, dodecyl phenol or dinonyl phenol, or a mixture of phenols (such as a mixture of t-butyl phenol and nonyl phenol). The dehazer should be used in an amount sufficient to inhibit the hazing that might otherwise occur when the gasoline without the dehazer contacts water, and this amount will be referred to herein as a "haze-inhibiting amount." Generally, this amount is from about 0.1 to about 20 ppmw (e.g. from about 0.1 to about 10 ppm), more preferably from 1 to 15 ppmw, still more preferably from 1 to 10 ppmw, advantageously from 1 to 5 ppmw based on the weight of the gasoline.

Further customary additives for use in gasolines are corrosion inhibitors, for example based on ammonium salts of organic carboxylic acids, said salts tending to form films, or of heterocyclic aromatics for nonferrous metal corrosion protection; antioxidants or stabilizers, for example based on amines such as phenyldiamines, e.g. p-phenylenediamine, N, N'-di-sec-butyl-p-phenyldiamine, dicyclohexylamine or derivatives thereof or of phenols such as 2,4-di-tert-butylphenol or 3,5-di-tert-butyl-4-hydroxy-phenylpropionic acid; anti-static agents; metallocenes such as ferrocene; methylcyclo-pentadienylmanganese tricarbonyl; lubricity additives, such as certain fatty acids, alkenylsuccinic esters, bis(hydroxyalkyl) fatty amines, hydroxyacetamides or castor oil; and also dyes (markers). Amines may also be added, if appropriate, for example as described in WO 03/076554. Optionally anti valve seat recession additives may be used such as sodium or potassium salts of polymeric organic acids.

The gasoline compositions herein can also comprise a detergent additive, in addition to the blend of monoalkyl alkenyl succinates described above. Suitable detergent additives include those disclosed in WO2009/50287, incorporated herein by reference.

Preferred detergent additives for use in the gasoline composition herein typically have at least one hydrophobic hydrocarbon radical having a number-average molecular weight (Mn) of from 85 to 20 000 and at least one polar moiety selected from:

(A1) mono- or polyamino groups having up to 6 nitrogen atoms, of which at least one nitrogen atom has basic properties;

(A6) polyoxy-$C_2$- to —$C_4$-alkylene groups which are terminated by hydroxyl groups, mono- or polyamino groups, in which at least one nitrogen atom has basic properties, or by carbamate groups;

(A8) moieties derived from succinic anhydride and having hydroxyl and/or amino and/or amido and/or imido groups; and/or (A9) moieties obtained by Mannich reaction of substituted phenols with aldehydes and mono- or polyamines.

The hydrophobic hydrocarbon radical in the above detergent additives, which ensures the adequate solubility in the base fluid, has a number-average molecular weight (Mn) of from 85 to 20 000, especially from 113 to 10 000, in particular from 300 to 5000. Typical hydrophobic hydrocarbon radicals, especially in conjunction with the polar moieties (A1), (A8) and (A9), include polyalkenes (polyolefins), such as the polypropenyl, polybutenyl and polyisobutenyl radicals each having Mn of from 300 to 5000, preferably from 500 to 2500, more preferably from 700 to 2300, and especially from 700 to 1000.

Non-limiting examples of the above groups of detergent additives include the following:

Additives comprising mono- or polyamino groups (A1) are preferably polyalkenemono- or polyalkenepolyamines based on polypropene or conventional (i.e. having predominantly internal double bonds) polybutene or polyisobutene having Mn of from 300 to 5000. When polybutene or polyisobutene having predominantly internal double bonds (usually in the beta and gamma position) are used as starting materials in the preparation of the additives, a possible preparative route is by chlorination and subsequent amination or by oxidation of the double bond with air or ozone to give the carbonyl or carboxyl compound and subsequent amination under reductive (hydrogenating) conditions. The amines used here for the amination may be, for example, ammonia, monoamines or polyamines, such as dimethylaminopropylamine, ethylenediamine, diethylene-triamine, triethylenetetramine or tetraethylenepentamine. Corresponding additives based on polypropene are described in particular in WO-A-94/24231.

Further preferred additives comprising monoamino groups (A1) are the hydrogenation products of the reaction products of polyisobutenes having an average degree of polymerization of from 5 to 100, with nitrogen oxides or mixtures of nitrogen oxides and oxygen, as described in particular in WO-A-97/03946.

Further preferred additives comprising monoamino groups (A1) are the compounds obtainable from polyisobutene epoxides by reaction with amines and subsequent dehydration and reduction of the amino alcohols, as described in particular in DE-A-196 20 262.

Additives comprising polyoxy-$C_2$-$C_4$-alkylene moieties (A6) are preferably polyethers or polyetheramines which are obtainable by reaction of $C_2$- to $C_{60}$-alkanols, $C_6$- to $C_{30}$-alkanediols, mono- or di-$C_2$-$C_{30}$-alkylamines, $C_1$-$C_{30}$-alkylcyclohexanols or $C_1$-$C_{30}$-alkylphenols with from 1 to 30 mol of ethylene oxide and/or propylene oxide and/or butylene oxide per hydroxyl group or amino group and, in the case of the polyether-amines, by subsequent reductive amination with ammonia, monoamines or polyamines. Such products are described in particular in EP-A-310 875, EP-A-356 725, EP-A-700 985 and U.S. Pat. No. 4,877,416. In the case of polyethers, such products also have carrier oil properties. Typical examples of these are tridecanol butoxylates, isotridecanol butoxylates, isononylphenol butoxylates and polyisobutenol butoxylates and propoxylates and also the corresponding reaction products with ammonia.

Additives comprising moieties derived from succinic anhydride and having hydroxyl and/or amino and/or amido and/or imido groups (A8) are preferably corresponding derivatives of polyisobutenylsuccinic anhydride which are obtainable by reacting conventional or highly reactive polyisobutene having Mn of from 300 to 5000 with maleic anhydride by a thermal route or via the chlorinated polyisobutene. Of particular interest are derivatives with aliphatic polyamines such as ethylenediamine, diethylenetriamine, triethylenetetramine or tetraethylenepentamine. Such additives are described in particular in U.S. Pat. No. 4,849,572.

Additives comprising moieties obtained by Mannich reaction of substituted phenols with aldehydes and mono- or polyamines (A9) are preferably reaction products of polyisobutene-substituted phenols with formaldehyde and mono- or polyamines such as ethylenediamine, diethylenetriamine, triethylenetetramine, tetraethylenepentamine or dimethylaminopropylamine. The polyisobutenyl-substituted phenols may stem from conventional or highly reactive polyisobutene having Mn of from 300 to 5000. Such "polyisobutene-Mannich bases" are described in particular in EP-A-831 141.

Preferably, the detergent additive used in the gasoline compositions of the present invention contains at least one nitrogen-containing detergent, more preferably at least one nitrogen-containing detergent containing a hydrophobic hydrocarbon radical having a number average molecular weight in the range of from 300 to 5000. Preferably, the nitrogen-containing detergent is selected from a group comprising polyalkene monoamines, polyetheramines, polyalkene Mannich amines and polyalkene succinimides. Conveniently, the nitrogen-containing detergent may be a polyalkene monoamine.

In the above, amounts (concentrations, % vol, ppmw, % wt) of components are of active matter, i.e. exclusive of volatile solvents/diluent materials.

The liquid fuel composition of the present invention can be produced by admixing the blend of monoalkyl alkenyl succinates with a gasoline base fuel suitable for use in an internal combustion engine, and optionally any further additive components.

The present invention will be further understood from the following examples. Unless otherwise stated, all amounts and concentrations disclosed in the examples are based on weight of the fully formulated fuel composition.

Examples

The goal of these experiments was to screen a set of monoalkyl alkenyl succinate blends for engine wear properties.

Preparation of Monoalkyl Alkenyl Succinates

The monoalkyl alkenyl succinates used in these examples were prepared as follows. To a three neck round bottom flask equipped with a heating mantel, glass stirring rod, thermometer, reflux condenser, inert dry nitrogen and a dropping funnel was added toluene followed by the addition of the relevant anhydride. The relevant alcohol was then added to the dropping funnel and while stirring, the mixture was warmed to 50° C.-60° C. at which time, methanol was slowly added via the dropping funnel to prepare the methyl ester. While using the other alcohols the reaction pot temperature was raised from 70° C. to 80° C. degrees while the higher chain alcohols were slowly added via the dropping funnel. The overall reaction time was 10 hours, at which time the reactor was allowed to cool overnight to room temperature. Some of the corresponding acid-esters were monitored via C13 NMR to determine if the correct temperature, addition rate and overall length of the reaction was optimum. In addition, the C13 NMR confirmed the expected two isomeric materials as well as the major and minor chemical structure. The reaction leading to the corresponding major and minor component can be seen below:

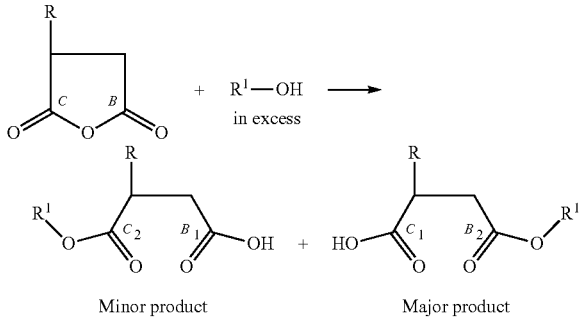

The C13 NMR analysis of fifteen alkyl succinates synthesized showed 100% complete reactions. A slight excess of alcohol remained with zero remaining of the alkyl succinic anhydride.

The alkenyl succinic anhydrides and the alcohols used to produce the alkenyl succinates used herein are listed in Table 1 below, together with the molecular weights of the starting materials and the molecular weights and yields of the products. C13 NMR analysis of fifteen of the alkyl succinates produced is set out in Table 2 below.

Gasoline fuel compositions were prepared by blending one or two of the alkenyl succinates prepared above with a standard additive package and then adding the resulting mixture to a reference fuel (an E10 base fuel (gasoline base fuel containing 10 vol % ethanol)). The standard gasoline additive package was the same in each fuel composition and contained detergents (other than the alkenyl succinates), dehazer, carrier fluid and solvent. The amount of standard gasoline additive package in all the fuel compositions was 172.8 PTB. The amounts and combinations of monoalkyl alkenyl succinates used in the fuel compositions are as set out in Table 3-5 below.

Wear Scar measurements for each of the fuel compositions set out in Tables 3-5 were taken using a High Frequency Reciprocating Rig (HERR) according to a modified version of ASTM D6079 using a gasoline conversion kit available from PCR instruments (London, UK). Procedures for using the HFRR with the gasoline conversion kit are provided in 'The Lubricity of Gasoline', D. P. Wei, H. A. Spikes & S. Koreck, Tribology Transactions, 42:4 813-823 (1999), which is incorporated herein by reference. The wear data is shown in Tables 3-5 below.

FIG. 1 is a graphical representation of the data set out in Table 3.

Figure 2:
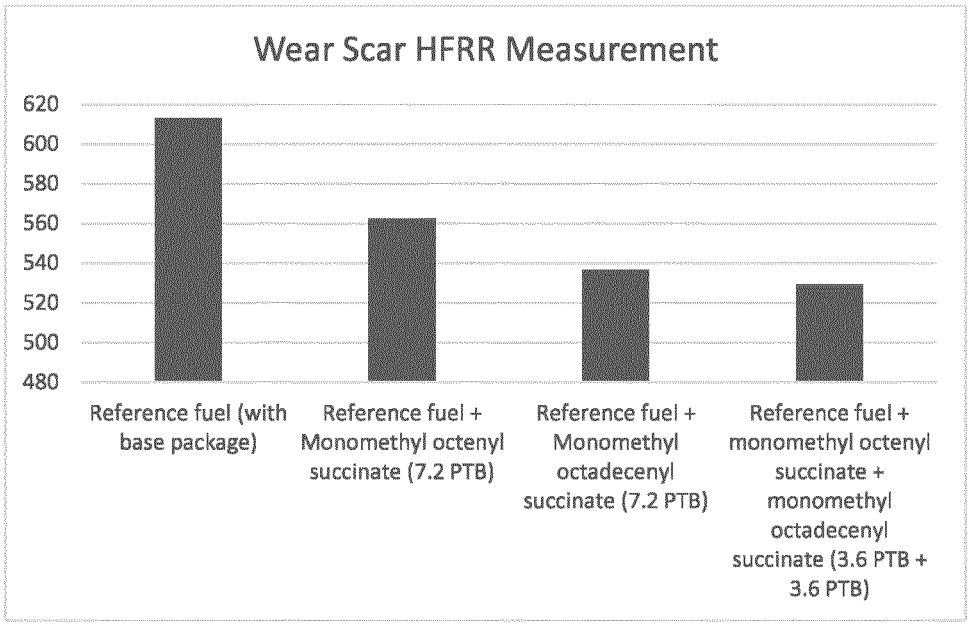
FIG. 2 is a graphical representation of the data shown in Table 4 below.

FIG. 2 is a graphical representation of the data set out in Table 4.

Figure 3:
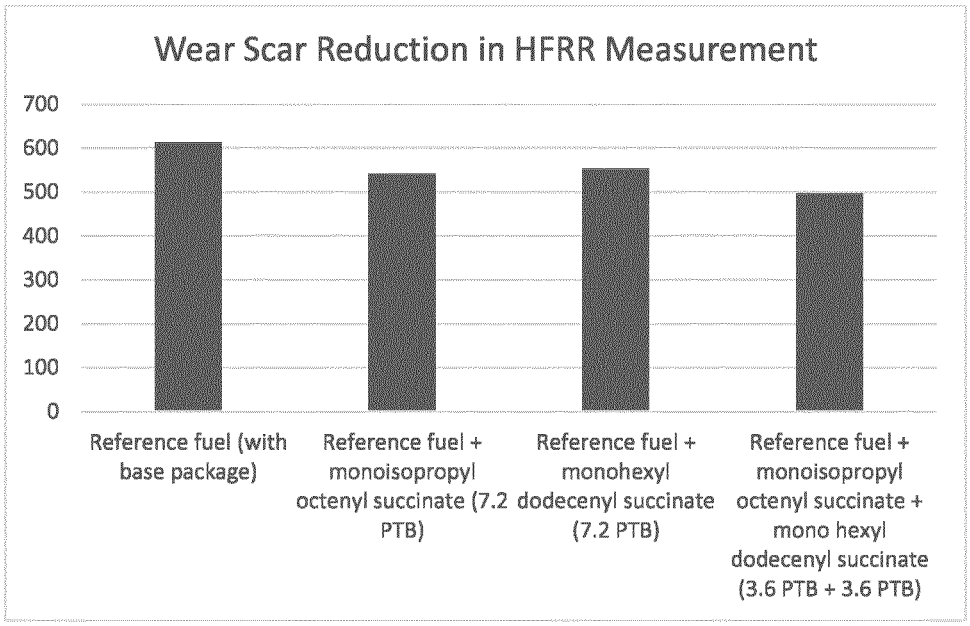
FIG. 3 is a graphical representation of the data shown in Table 5 below.

FIG. 3 is a graphical representation of the data set out in Table 5.

TABLE 1

| Anhydrides | Anhydride MW[2] | Alcohols | Alcohol MW | Acid-Ester MW | Amount of Sample Recovered (g) | Alkyl succinate name |
|---|---|---|---|---|---|---|
| n-Octenyl Succinic Anhydride | 210.27 | Methanol | 32.04 | 242.32 | 149.7 | Mono methyl octenyl succinate |
| n-Octenyl Succinic Anhydride | 210.27 | 1-Propanol | 60.10 | 270.37 | 155.2 | Mono n-propyl octenyl succinate |
| n-Octenyl Succinic Anhydride | 210.27 | 1-Pentanol | 88.15 | 298.42 | 182.4 | Mono n-pentyl octenyl succinate |
| n-Octenyl Succinic Anhydride | 210.27 | 1-Hexanol | 102.18 | 312.45 | 174.6 | Mono n-hexyl octenyl succinate |
| n-Octenyl Succinic Anhydride | 210.27 | 2-Propanol | 60.10 | 270.37 | 161.5 | Mono isopropyl octenyl succinate |
| n-Dodecenyl Succinic Anhydride | 266.38 | Methanol | 32.04 | 298.42 | 152.8 | Mono methyl dodecenyl succinate |

TABLE 1-continued

| Anhydrides | Anhydride MW[2] | Alcohols | Alcohol MW | Acid-Ester MW | Amount of Sample Recovered (g) | Alkyl succinate name |
|---|---|---|---|---|---|---|
| n-Dodecenyl Succinic Anhydride | 266.38 | 1-Propanol | 60.10 | 326.48 | 152.8 | Mono n-propyl dodecenyl succinate |
| n-Dodecenyl Succinic Anhydride | 266.38 | 1-Pentanol | 88.15 | 354.53 | 183.2 | Mono n-pentyl dodecenyl succinate |
| n-Dodecenyl Succinic Anhydride | 266.38 | 1-Hexanol | 102.18 | 368.56 | 182.5 | Mono n-hexyl dodecenyl succinate |
| n-Dodecenyl Succinic Anhydride | 266.38 | 2-Propanol | 60.10 | 326.48 | 153.0 | Mono isopropyl dodecenyl succinate |
| Hexadecenylsuccinic Anhydride | 322.49 | Methanol | 32.04 | 354.53 | 146.5 | Mono methyl hexadecenyl succinate |
| Hexadecenylsuccinic Anhydride | 322.49 | 1-Propanol | 60.10 | 382.59 | 150.5 | Mono n-propyl hexadecenyl succinate |
| Hexadecenylsuccinic Anhydride | 322.49 | 1-Pentanol | 88.15 | 410.64 | 157.8 | Mono n-pentyl hexadecenyl succinate |
| Hexadecenylsuccinic Anhydride | 322.49 | 1-Hexanol | 102.18 | 424.67 | 165.1 | Mono hexyl hexadecenyl succinate |
| Hexadecenylsuccinic Anhydride | 322.49 | 2-Propanol | 60.10 | 382.59 | 138.7 | Mono isopropyl hexadecenyl succinate |
| n-ASA 1618[1] | 325.21 | Methanol | 32.04 | 357.25 | 147.5 | Mono methyl n-ASA1618 succinate |
| n-ASA 1618[1] | 325.21 | 1-Propanol | 60.10 | 385.31 | 159.8 | Mono n-propyl n-ASA1618 succinate |
| n-ASA 1618[1] | 325.21 | 1-Pentanol | 88.15 | 413.36 | 160.2 | Mono n-pentyl n-ASA1618 succinate |
| n-ASA 1618[1] | 325.21 | 1-Hexanol | 102.18 | 427.39 | 169.3 | Mono n-hexyl n-ASA1618 succinate |
| n-ASA 1618[1] | 325.21 | 2-Propanol | 60.10 | 385.31 | 142.8 | Mono isopropyl n-ASA1618 succinate |
| Octadecenyl succinic Anhydride | 350.54 | Methanol | 32.04 | 382.59 | 144.2 | Mono methyl octadecenyl succinate |
| Octadecenyl succinic Anhydride | 350.54 | 1-Propanol | 60.10 | 410.64 | 153.8 | Mono n-propyl octadecenyl succinate |
| Octadecenyl succinic Anhydride | 350.54 | 1-Pentanol | 88.15 | 438.69 | 157.2 | Mono n-pentyl octadecenyl succinate |
| Octadecenyl succinic Anhydride | 350.54 | 1-Hexanol | 102.18 | 452.72 | 167.8 | Mono n-hexyl octadecenyl succinate |

[1]Alkenyl Succinic anhydride containing a mixture of C16 and C18 alkyl chains
[2]Molecular Weight

TABLE 2

NMR C13 Analysis of fifteen alkyl succinates

| Alkyl succinate name | Major Product[1] A % mol, 00%*A/(A = B + S) | Minor Product[1] B % mol ,100%*S/(A + B + S) | Leftover Anhydride[1] S % mol, 100%*S/(A + B + S) | Excess Alcohol to (A + B + S) mole ratio |
|---|---|---|---|---|
| Mono methyl octenyl succinate | 62.9 | 37.1 | 0.00 | 0.06 |
| Mono n-propyl octenyl succinate | NM[2] | NM[2] | NM[2] | NM[2] |
| Mono n-pentyl octenyl succinate | 63.4 | 36.6 | 0.00 | 0.72 |
| Mono n-hexyl octenyl succinate | 63.3 | 36.7 | 0.00 | 0.49 |
| Mono isopropyl octenyl succinate | 62.9 | 37.1 | 0.00 | 0.45 |
| Mono methyl dodecnyl succinate | NM[2] | NM[2] | NM[2] | NM[2] |
| Mono n-propyl dodecenyl succinate | 63.0 | 37.0 | 0.00 | 0.18 |
| Mono n-pentyl dodecenyl succinate | 63.4 | 36.6 | 0.00 | 0.91 |
| Mono n-hexyl dodecenyl succinate | NM[2] | NM[2] | NM[2] | NM[2] |
| Mono isopropyl dodecenyl succinate | NM[2] | NM[2] | NM[2] | NM[2] |
| Mono methyl hexadecenyl succinate | NM[2] | NM[2] | NM[2] | NM[2] |
| Mono n-propyl hexadecenyl succinate | 80.5 | 19.5 | 0.00 | 0.19 |

TABLE 2-continued

NMR C13 Analysis of fifteen alkyl succinates

| Alkyl succinate name | Major Product[1] A % mol, 00%*A/ (A = B + S) | Minor Product[1] B % mol ,100%*S/ (A + B + S) | Leftover Anhydride[1] S % mol, 100%*S/ (A + B + S) | Excess Alcohol to (A + B + S) mole ratio |
|---|---|---|---|---|
| Mono n-pentyl hexadecenyl succinate | 79.2 | 20.8 | 0.00 | 0.32 |
| Mono hexyl hexadecenyl succinate | 80.2 | 19.8 | 0.00 | 0.57 |
| Mono isopropyl hexadecenyl succinate | NM[2] | NM[2] | NM[2] | NM[2] |
| Mono methyl n-ASA1618 succinate | NM[2] | NM[2] | NM[2] | NM[2] |
| Mono n-propyl n-ASA1618 succinate | 66.0 | 34.0 | 0.00 | 0.57 |
| Mono n-pentyl n-ASA1618 succinate | 66.2 | 33.8 | 0.00 | 0.39 |
| Mono n-hexyl n-ASA1618 succinate | 66.5 | 33.5 | 0.00 | 0.59 |
| Mono isopropyl n-ASA1618 succinate | NM[2] | NM[2] | NM[2] | NM[2] |
| Mono methyl octadecenyl succinate | NM[2] | NM[2] | NM[2] | NM[2] |
| Mono n-propyl octadecenyl succinate octadecenyl succinate | 79.4 | 20.6 | 0.00 | 0.38 |
| Mono n-pentyl octadecenyl succinate | 79.7 | 20.3 | 0.00 | 0.36 |
| Mono n-hexyl octadecenyl succinate | 79.8 | 20.2 | 0.00 | 0.62 |

[1]A = Major Product, B = Minor Product, S = Starting Anhydride
[2]NM = Not measured

TABLE 3

| Example | Wear Scar measurement (μm) | Wear Scar Reduction (versus Reference fuel) |
|---|---|---|
| Reference fuel (with base package) | 613 | — |
| Reference fuel + Monomethyl octenyl succinate (7.2 PTB) | 562.3 | 50.7 |
| Reference fuel + Monohexyl C16/C18 succinate (7.2 PTB) | 555.5 | 57.5 |
| Reference fuel + Monomethyl octenyl succinate (3.6 PTB) + Monohexyl C16/C18 succinate (3.6 PTB) | 525.8 | 87.2 |

TABLE 4

| Example | Wear Scar Measurement (μm) | Wear Scar Reduction (versus Reference fuel) |
|---|---|---|
| Reference fuel (with base package) | 613 | — |
| Reference fuel + Monomethyl octenyl succinate (7.2 PTB) | 562.3 | 50.7 |
| Reference fuel + Monomethyl octadecenyl succinate (7.2 PTB) | 536.5 | 76.5 |
| Reference fuel + monomethyl octenyl succinate (3.6 PTB) + | 529.3 | 83.7 |

TABLE 4-continued

| Example | Wear Scar Measurement (μm) | Wear Scar Reduction (versus Reference fuel) |
|---|---|---|
| monomethyl octadecenyl succinate (3.6 PTB) | | |

TABLE 5

| Example | Wear Scar Measurement (μm) | Reduction in Wear Scar versus reference fuel |
|---|---|---|
| Reference fuel (with base package) | 613 | — |
| Reference fuel + Monoisopropyl octenyl succinate (7.2 PTB) | 541.8 | 71.2 |
| Reference fuel + Monohexyl dodecenyl succinate (7.2 PTB) | 552.3 | 60.7 |
| Reference fuel + Monoisopropyl octenyl succinate (3.6 PTB) + monohexyl dodecenyl succinate (3.6 PTB) | 495.8 | 117.2 |

DISCUSSION

The data contained in Tables 3-5 and FIGS. 1 to 3 demonstrate that blending specific monoalkyl alkenyl succinates together resulted in a synergistic response in the wear reduction of the blend over the individual components. This synergistic benefit in wear performance could not have been predicted or achieved via the individual alkyl succinate components.

The invention claimed is:

1. Fuel composition comprising:

(i) a base fuel suitable for use in an internal combustion engine, wherein the base fuel is a gasoline base fuel; and (ii) a blend of a first monoalkyl alkenyl succinate and a second monoalkyl alkenyl succinate wherein the first monoalkyl alkenyl succinate is a compound of formula (I) or (II) below, or an isomeric mixture of formula (I) and (II) below, wherein R is a linear or branched alkenyl group containing from 4 to 8 carbon atoms, and $R^1$ is a linear or branched $C_1$ to $C_4$ alkyl group and the second monoalkyl alkenyl succinate is a compound of formula (I) or (II) below, or an isomeric mixture of formula (I) and (II) below, wherein R is a linear or branched alkenyl group containing from 10 to 22 carbon atoms, and $R^1$ is a linear or branched $C_1$ to $C_6$ alkyl group;

(I)

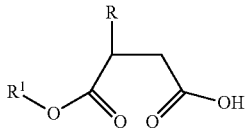

(II)

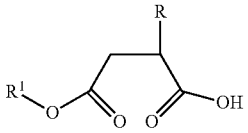

and wherein the first monoalkyl alkenyl succinate is different from the second monoalkyl alkenyl succinate.

2. Fuel composition according to claim 1, wherein the fuel composition is a gasoline fuel composition.

3. Fuel composition according to claim 1, wherein the first monoalkyl alkenyl succinate is a compound of formula (I) or (II), or an isomeric mixture of formula (I) and (II), wherein R is a linear or branched alkenyl group containing from 6 to 8 carbon atoms, and $R^1$ is a linear or branched $C_1$ to $C_3$ alkyl group.

4. Fuel composition according to claim 1, wherein the second monoalkyl alkenyl succinate is a compound of formula (I) wherein R is a linear or branched alkenyl group containing from 12 to 18 carbon atoms, and $R^1$ is a linear or branched $C_1$ to $C_6$ alkyl group.

5. Fuel composition according to claim 1, wherein the total amount of first monoalkyl succinate and second monoalkyl succinate is in the range from 2 PTB to 262.3PTB, by weight of the fuel composition.

6. Fuel composition according to claim 1, wherein the weight ratio of first monoalkyl succinate to second monoalkyl succinate is in the range from 90:10 to 10:90.

7. A method for providing a synergistic reduction in engine wear of an internal combustion engine, comprising fueling the internal combustion engine with a fuel composition comprising:

(iii) a base fuel suitable for use in an internal combustion engine, wherein the base fuel is a gasoline base fuel; and (iv) a blend of a first monoalkyl alkenyl succinate and a second monoalkyl alkenyl succinate wherein the first monoalkyl alkenyl succinate is a compound of formula (I) or (II) below, or an isomeric mixture of formula (I) and (II) below, wherein R is a linear or branched alkenyl group containing from 4 to 8 carbon atoms, and $R^1$ is a linear or branched $C_1$ to $C_4$ alkyl group, and the second monoalkyl alkenyl succinate is a compound of each have the formula (I) or (II) below, or an isomeric mixture of formula (I) and (II) below, wherein R is a linear or branched alkenyl group containing from 10 to 22 carbon atoms, and $R^1$ is a linear or branched $C_1$ to $C_6$ alkyl group;

(I)

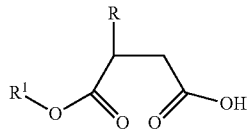

(II)

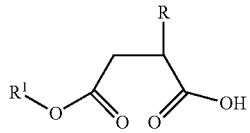

and wherein the first monoalkyl alkenyl succinate is different from the second monoalkyl alkenyl succinate.

8. The method of claim 7, wherein the fuel composition is a gasoline fuel composition.

9. The method of claim 7, wherein the first monoalkyl alkenyl succinate is a compound of formula (I) or (II), or an isomeric mixture of formula (I) and (II), wherein R is a linear or branched alkenyl group containing from 6 to 8 carbon atoms, and $R^1$ is a linear or branched $C_1$ to $C_3$ alkyl group.

10. The method of claim 7, wherein the second monoalkyl alkenyl succinate is a compound of formula (I) wherein R is a linear or branched alkenyl group containing from 12 to 18 carbon atoms, and $R^1$ is a linear or branched $C_1$ to $C_6$ alkyl group.

11. The method of claim 7, wherein the total amount of first monoalkyl succinate and second monoalkyl succinate is in the range from 2 PTB to 262.3PTB, by weight of the fuel composition.

12. The method of claim 7, wherein the weight ratio of first monoalkyl succinate to second monoalkyl succinate is in the range from 90:10 to 10:90.

* * * * *